US005538130A

United States Patent [19]

Harrelson

[11] Patent Number: 5,538,130

[45] Date of Patent: Jul. 23, 1996

[54] BASKET-STYLE CARRIER WITH DIVIDING STRAP

[75] Inventor: Glen R. Harrelson, Roswell, Ga.

[73] Assignee: Riverwood International Corporation, Atlanta, Ga.

[21] Appl. No.: 391,898

[22] Filed: Feb. 21, 1995

[51] Int. Cl.[6] ..... B65D 75/00

[52] U.S. Cl. ..... 206/162; 206/172; 206/193; 206/200; 206/428

[58] Field of Search ..... 206/141, 142, 206/147, 148, 149, 152, 156, 162, 165, 167, 170, 172, 174, 175, 180, 183, 184, 185, 189, 193, 197, 200, 427, 428; 294/87.2

[56] References Cited

U.S. PATENT DOCUMENTS

| | | | |
|---|---|---|---|
| 2,134,627 | 10/1938 | Turner | 206/162 X |
| 2,361,926 | 11/1944 | Brogden | 206/428 X |
| 2,364,651 | 12/1944 | Powell | 206/180 X |
| 2,576,179 | 11/1951 | Holy | 206/162 |
| 2,660,361 | 11/1953 | Tyrseck | 206/180 X |
| 2,756,900 | 7/1956 | Collora | 206/184 |
| 2,772,020 | 11/1956 | Kramer | 206/180 |
| 4,250,992 | 2/1981 | Gilbert | 206/162 |
| 4,546,914 | 10/1985 | Roccaforte | 206/141 X |
| 4,722,487 | 2/1988 | Walsh | 206/170 |
| 4,782,944 | 11/1988 | Engdahl, Sr. | 206/185 |

*Primary Examiner*—Paul T. Sewell
*Assistant Examiner*—Tara L. Laster

[57] ABSTRACT

A basket-style article carrier for carrying nonbreakable articles. A divider strap is connected to and extends between opposite side panels. The strap is connected to the side panels by a glue flap at each end, one of which is connected by fold line to the upper edge of the associated side panel. The strap causes the carrier to resist bowing when an article is removed, thereby preventing excessive sagging which otherwise tends to allow the remaining articles in the carrier to fall out.

7 Claims, 4 Drawing Sheets

BASKET-STYLE CARRIER WITH DIVIDING STRAP

FIELD OF THE INVENTION

This invention relates to basket-style carriers. More particularly, it relates to an economical basket-style carrier having improved rigidity.

BACKGROUND OF THE INVENTION

Certain products, such as beverage bottles, are often sold in basket-style carriers. Basket-style carriers are easy to lift and carry and are normally quite strong, their rigidity and resistance to deformation being aided by the divider partitions which conventionally extend from a center panel to the side panels to form individual cells for the bottles.

The strength of a basket-style carrier is of concern, however, in connection with the packaging of plastic bottles. Since contact between adjacent plastic bottles does not result in breakage, there is no need to separate the bottles with dividers. The amount of paperboard or other material required in the manufacture of the carriers is correspondingly reduced, resulting in a more economical carrier. When the carrier is designed to carry heavy loads, however, as may result from packaging large heavy bottles or large numbers of bottles, the lack of adequate carrier strength caused by the absence of the cell partitions is often revealed after a bottle is removed from the carrier. When one or more bottles are removed, the uneven weight distribution of the remaining bottles tends to cause the carrier to bow. This in turn causes the package to sag and can cause the remaining bottles to fall out when the carrier is lifted.

Carriers of this type are further weakened when the end panels are designed to permit the lower portions of the end bottles to be exposed to view. This is a desirable design when the shape of the bottles or other packaged articles is suggestive of the brand. However, it contributes to the lack of carrier strength, since removal of the lower portions of the end panels reduces the rigidity of the structure.

It is an object of the invention to provide a basket-style article carrier of the type which does not contain individual article cells, but which nevertheless provides adequate strength and resistance to bowing when one or more articles are removed. It is also an object to provide such a carrier with sufficient strength to permit lower portions of the end articles to be exposed to view.

BRIEF SUMMARY OF THE INVENTION

The basket-style carrier of the invention is an economical carrier which does not include individual partitions or cells for each article, but instead provides an open area between the side panels and the end panels in which the articles are contained. A handle is provided for lifting the carrier. In addition to this arrangement, a strap is connected to, and extends between, the side panels. The strap strengthens the carrier, causing it to resist inward movement of the side panels toward each other when an article is removed, thereby resisting bowing or sagging and eliminating the danger of an article falling from the carrier.

Preferably, opposite ends of the strap are connected to the side panels by glue flaps, one of the glue flaps being connected to the upper edge of one of the side panels by a fold line. This arrangement allows the carrier, including strap, to be formed from an integral blank. The strap preferably is substantially centrally located on the side panels.

The carrier is inexpensive to produce and simple to form from a blank. In addition, the carrier design permits portions of the end panels to be cut away so that substantial portions of the end packaged articles are exposed to view without unduly weakening the carrier.

The features which enable the carrier to function in this manner are brought out in more detail in connection with the description of the preferred embodiments, wherein the above and other aspects of the invention, as well as other benefits, will readily become apparent.

DETAILED DESCRIPTION OF THE PREFERRED EMBODIMENTS

Figure 1:
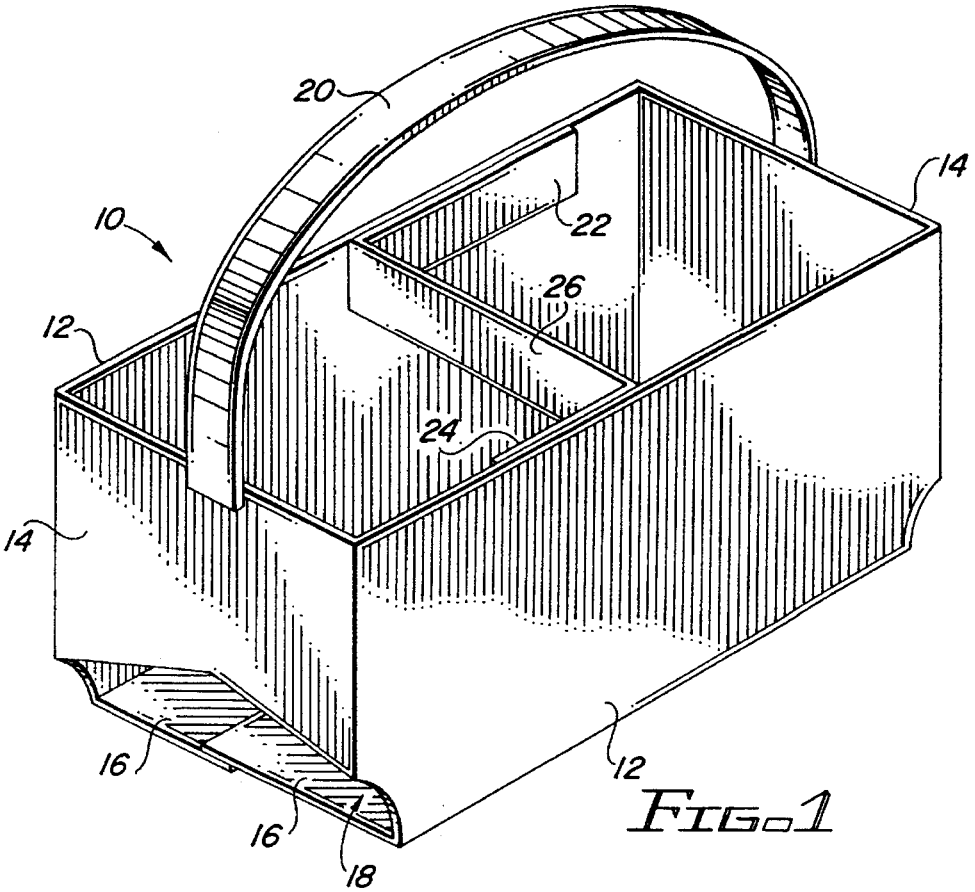
FIG. 1 is a pictorial view of the carrier of the invention, shown in connection with two rows of packaged bottles.
Figure 2:
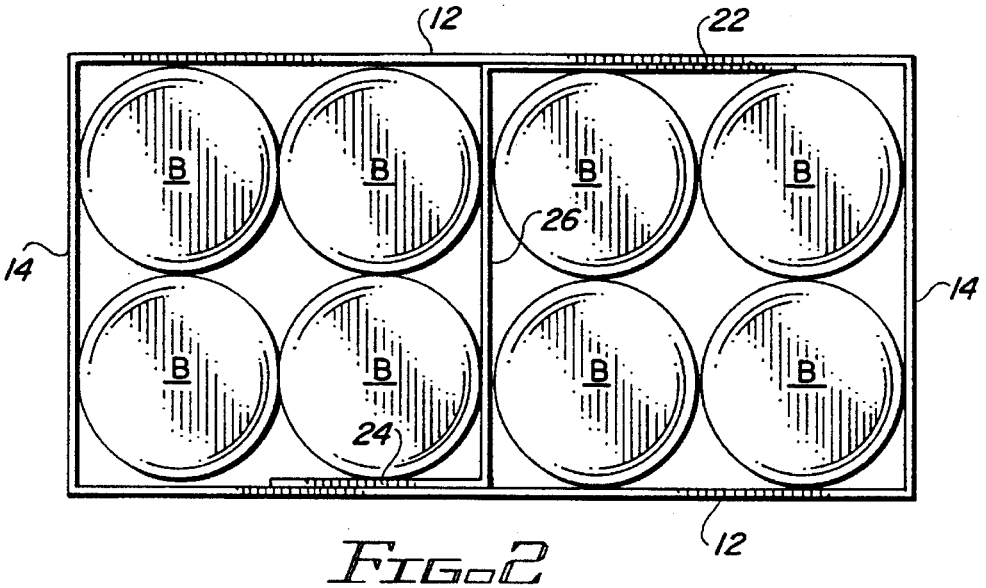
FIG. 2 is a plan view of the carrier, with the handle removed, showing the bottle arrangement in the carrier.
Figure 3:
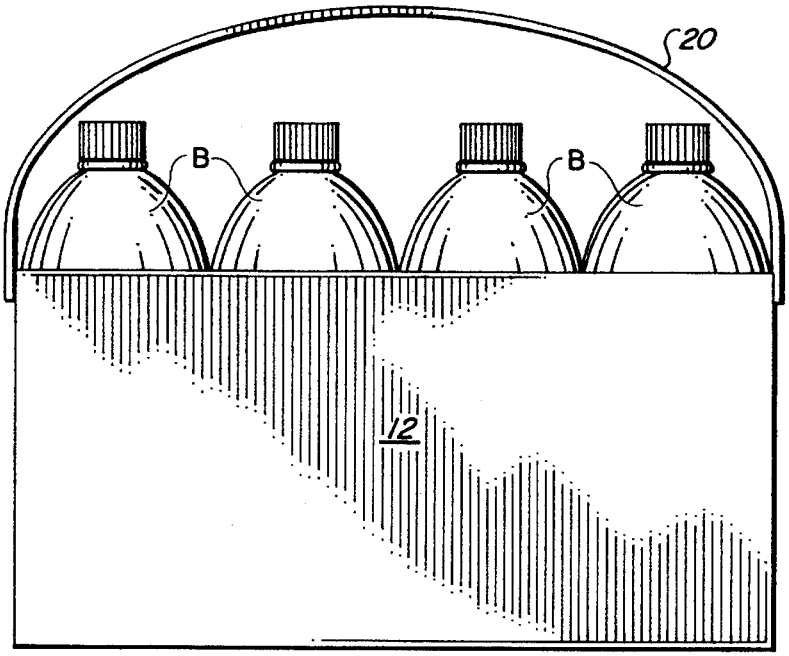
FIG. 3 is a side elevation of the carrier.

A carrier designed to hold eight bottles in two rows of four each is indicated in FIGS. 1, 2 and 3 by the reference numeral 10. The bottles have been omitted from FIG. 1 in order to better illustrate the interior of the carrier, and have been schematically shown at B in FIG. 2 to illustrate their arrangement in the package. The carrier is comprised of opposite side panels 12 which are connected to opposite end panels 14. Also connected to the side panels are overlapping bottom panel flaps 16 which are adhered together, as by glue, to form the bottom panel of the carrier. The upper edges of the side and end panels are located well below the necks of the bottles, thereby allowing the shape of the upper portions of the bottles to be seen, while the lower end portions of the side panels and the lower portions of the end panels are open to view to provide open cut-away areas 18 which expose the lower portions of the bottles. A handle 20 is also provided. The handle may take any desired form but has been illustrated as comprising a strap which has been adhered, as by tape or adhesive, to the end panels 14.

Connected to the upper central portions of the side panels 12 by glue flaps 22 and 24 is divider strap 26, which extends between the interior bottles of each row. If the strap were not present the side panels would move in toward each other in response to sagging of the bottom panel when the carrier is lifted after one or more bottles have been removed. The strap functions as a cross beam, resisting inward movement of the side panels toward each other. Since the side panels are unable to move in response to sagging, the sagging itself is thereby resisted.

Figure 4:
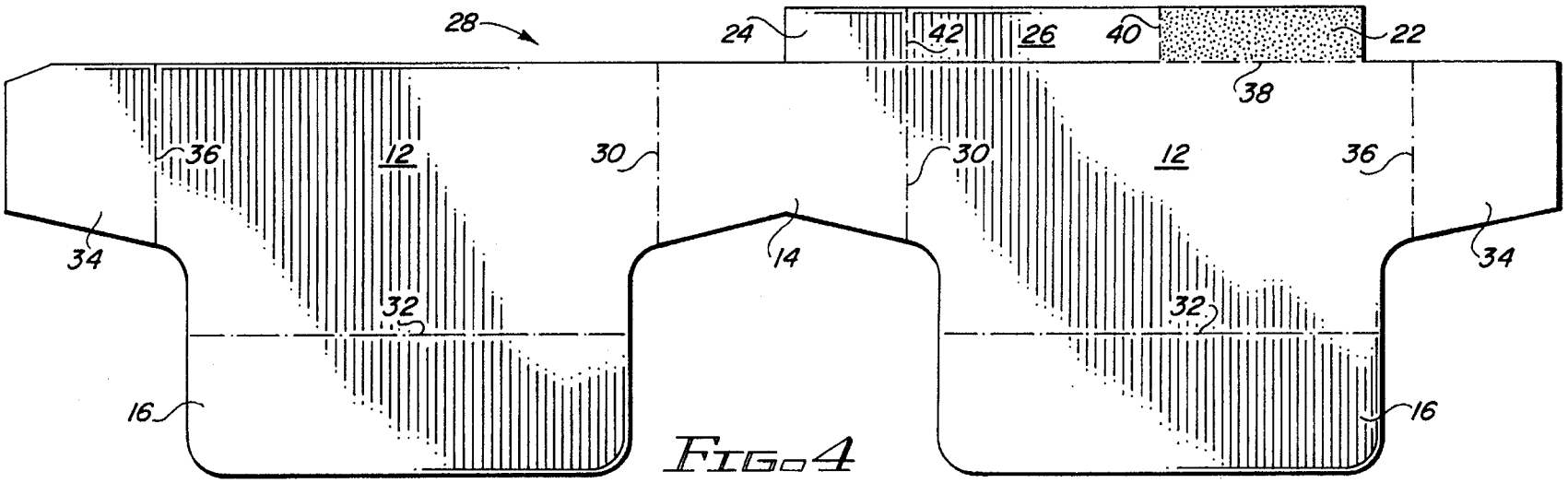
FIG. 4 is a plan view of a blank for forming the carrier of FIG. 1.

A blank 28 for forming the carrier is shown in FIG. 4. The blank is preferably formed of paperboard, but may be formed of any suitable material having sufficient strength and flexibility to function in the manner of paperboard. The blank includes a centrally located end panel section 14 connected by fold lines 30 to the side panel sections 12. Also connected to the side panel sections 12 by fold lines 32 are the bottom panel flaps 16. End panel flaps 34 located at opposite ends of the blank are connected to the adjacent side panel section by fold lines 36, which extend parallel to the fold lines 30. The glue flap 22 is connected by fold line 38 to the upper edge of the side panel section 12 at the right of the drawing and the glue flap 24, and is connected by fold line 40 to an end of the strap 26. The glue flap 24 is connected by fold line 42 to the opposite end of the strap 26. The fold line 42 is substantially an extension of the fold line 30, and the fold line 40, which is parallel to the fold line 42, extends upwardly from the upper edge of the side panel section 12 at substantially the midpoint of the length of the side panel section. Only the glue flap 22 is foldably connected to the adjacent side panel section. The strap 26 is separated from the side panel section by a slit. Similarly, the glue flap 24 is separated from the end panel section 14 by a slit.

Figure 5:
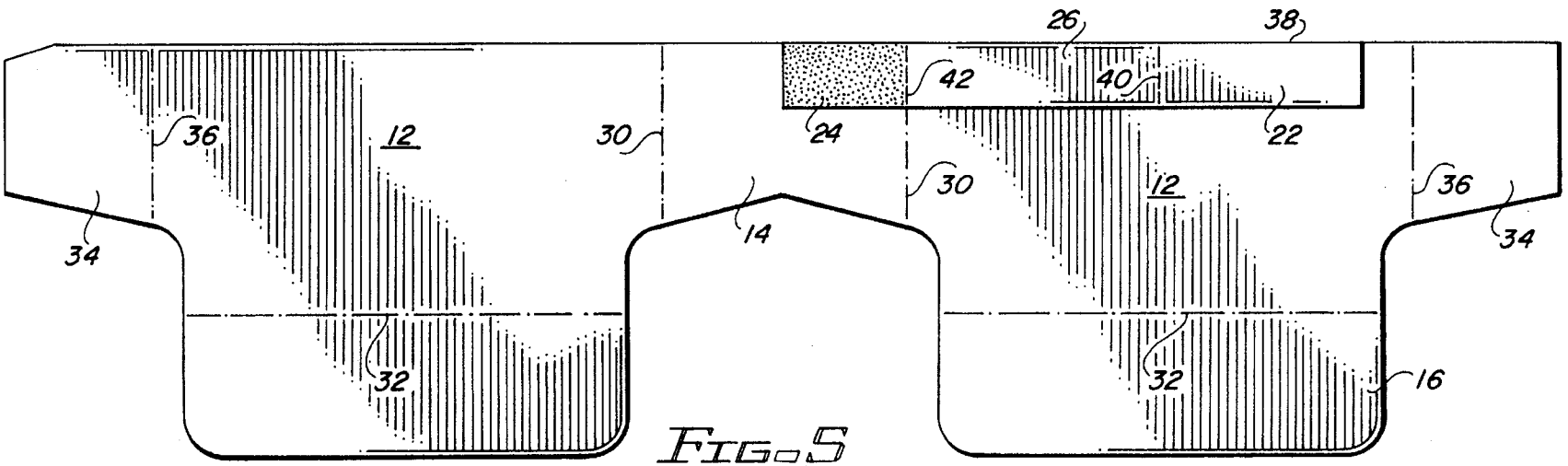
FIG. 5 is a plan view of the blank after an initial folding and gluing step has been performed.
Figure 6:
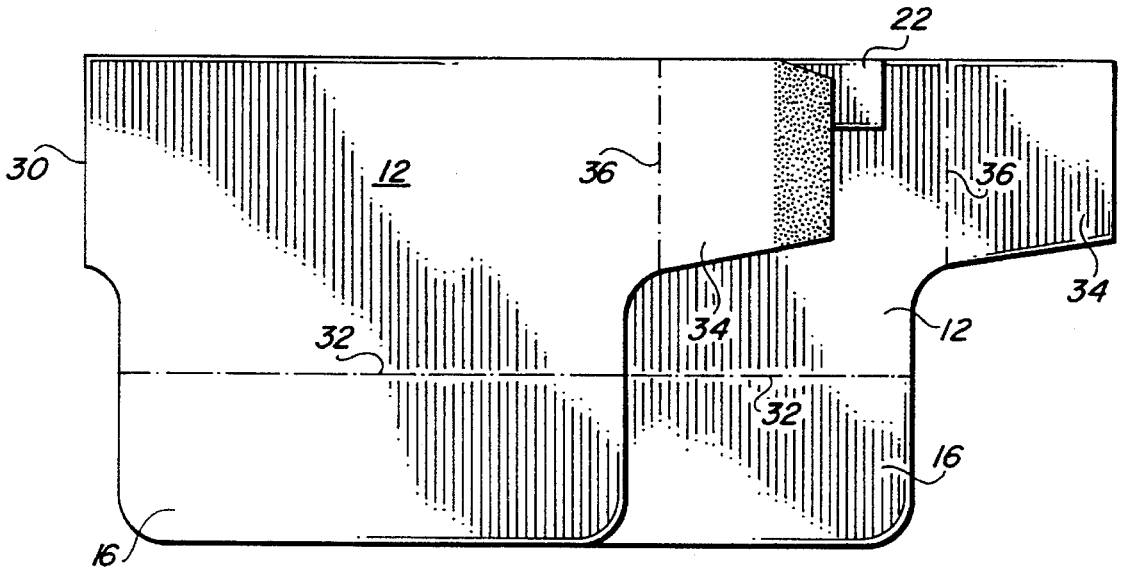
FIG. 6 is a plan view of the blank after a further folding and gluing step has been carried out.
Figure 7:
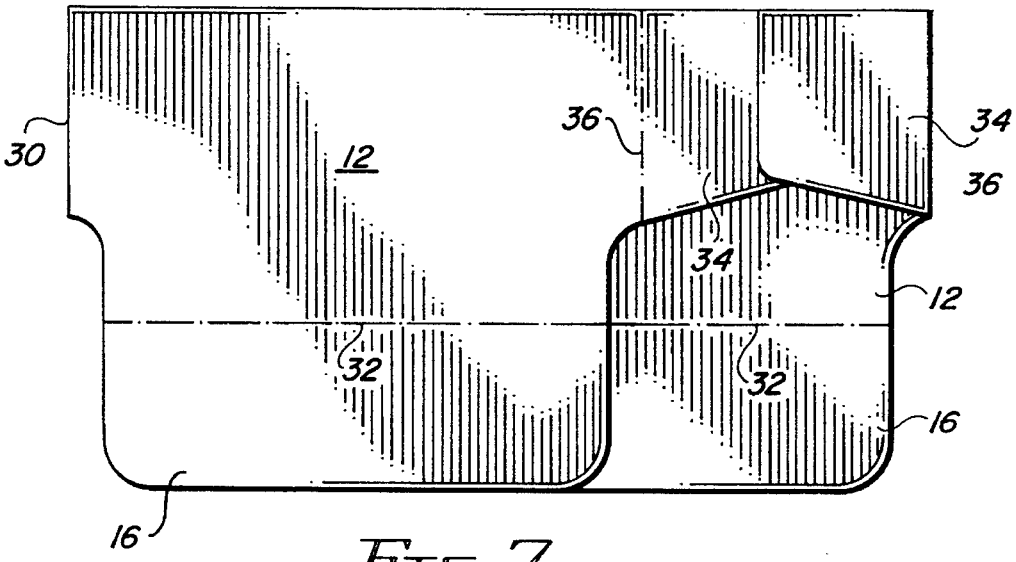
FIG. 7 is a plan view of a collapsed carrier.

To form a carrier from the blank 28, glue is applied to the glue flap 22, as indicated in stipple in FIG. 4, after which the glue flap is folded down about the fold line 38 to adhere the glue flap to the adjacent side panel section 12. The connected strap 26 and the glue flap 24 move with the glue flap 22 to the position shown in FIG. 5. Glue is then applied to the glue flap 24, as shown in stipple in FIG. 5, and the side panel section at the left of the blank is folded about the fold line 30 to produce the interim form of carrier shown in FIG. 6. In this manner the glue flap 24 is adhered to the overlying side panel section 12. The strap 26 is not adhered to any surface. Glue is then applied to the end portion of the uppermost end panel flap 34, after which the other end panel flap is folded about its fold line 36 to form the collapsed carrier illustrated in FIG. 7.

The collapsed carrier is opened or squared up by applying opposite inwardly directed forces against the end fold lines 30 and 36, after which the bottom panel flaps 16 are folded up to their final overlapping condition and adhered to each other by glue. Of course, mechanical locking means could be utilized instead of glue to hold the bottom panel flaps together. The finished carrier can then be loaded and the handle applied.

Opening of the collapsed carrier results in the central divider strap 26 automatically being moved into its final position spanning the width of the carrier from one side panel to the other. As mentioned above, the presence of the divider strap causes the carrier to resist excessive bowing of the carrier when bottles are removed, thereby assisting in retaining the remaining bottles in the carrier.

Although the divider strap has been indicated as preferably being located midway between the end panels, in practice its flexible nature allows it to be positioned slightly off center without adversely affecting its function or interfering with the loading of the bottles. The narrow width of the strap and the connected glue flaps adds only a minor amount to the area of the blank, thus adding only slightly to the cost of a carrier designed to contain nonbreakable articles.

The strengthening of the carrier resulting from the divider strap permits the carrier to be designed so that the lower portion of the end bottles and the upper portion of all the bottles can be seen. This is reflected in the blank by the short end panel sections and the fact that the lower edges of the side panel sections are offset from the corner fold lines. In addition, even though the end panels are cut away, they are still located so as to cover the pricing bar code on the bottles, thereby eliminating the problem of a retail scanner erroneously recording the price on an end bottle instead of the price represented by the bar code on the package.

Figure 8:
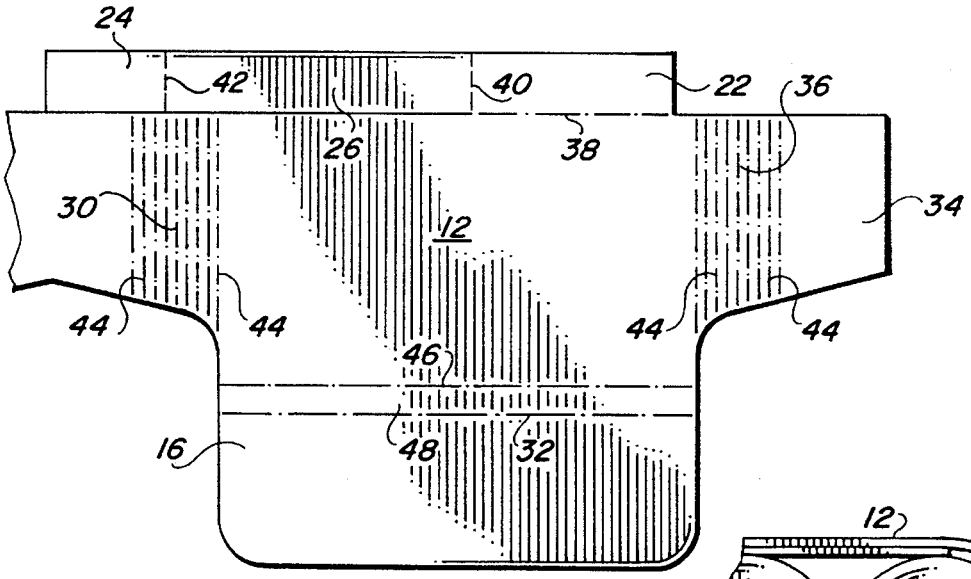
FIG. 8 is a partial plan view of a blank for forming a slightly modified form of carrier.
Figure 9:
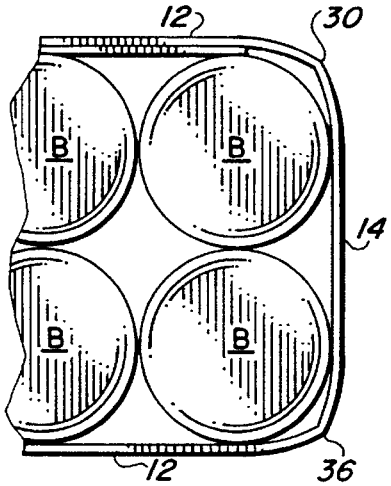
FIG. 9 is a partial plan view of the modified carrier.

If desired, the carrier blank may be modified as shown in FIG. 8 to include spaced vertical score lines 44 on either side of the corner fold lines 30 and 36. This arrangement enables the side and end panels adjacent the corners to yield along these score lines so that the carrier panels can more closely follow the contour of adjacent curved articles, as illustrated in FIG. 9. Score lines 46, spaced slightly above and parallel to the score lines 32, may also be provided to produce a short bevel panel 48 which is capable of more closely following the inwardly tapered lower portion found on many plastic beverage bottles.

Although the carrier blank has been described as having two end panel flaps and two bottom panel flaps, it will be understood that a single longer end panel flap could be provided instead to form an end panel of the carrier and that a single longer bottom panel flap could be provided to form the bottom panel of the carrier. The arrangement described is preferred, however, from the standpoint of more efficiently laying out the blank in the web from which it is cut.

While the invention is not limited to a carrier designed to contain eight bottles or other articles, the generally central location of the divider strap makes it functional only in carriers which hold rows of even numbers of articles.

It will be understood that the invention is not limited to all the specific details described in connection with the preferred embodiments, except as they may be within the scope of the appended claims. Changes to certain features of the preferred embodiment which do not alter the overall basic function and concept of the invention are therefore contemplated.

What is claimed is:

1. A basket-style article carrier, comprising:

a bottom panel connected by fold lines to opposite side panels;

opposite end panels connected by fold lines to the side panels;

a strap connected to the side panels and extending continuously therebetween;

a handle connected to the carrier for lifting the carrier;

the strap being connected along fold lines at opposite ends thereof to glue flaps, the glue flaps being adhered to the side panels; and one of the glue flaps being integrally connected by a fold line to one of the side panels.

2. A package, comprising:

a basket-style article carrier containing two adjacent rows of substantially nonbreakable articles, each row containing an even number of articles;

a bottom panel connected by fold lines to opposite side panels;

opposite end panels connected by fold lines to the side panels;

a strap connected to the side panels and extending continuously therebetween, the strap separating half of the articles in each row from the other half of the articles in each row;

a handle connected to the carrier for lifting the carrier;

the strap being connected along fold lines at opposite ends thereof to glue flaps, the glue flaps being adhered to the side panels; and one of the glue flaps being foldably connected to one of the side panels along an upper edge of said one side panel.

3. A package as defined in claim 2, wherein the articles are plastic beverage bottles, there being four beverage bottles in each row.

4. A package as defined in claim 2, wherein each end panel is spaced from the bottom panel to provide a cut-away portion through which the lower portion of the articles adjacent the end panels are exposed to view.

5. A basket-style article carrier, comprising:

a bottom panel connected by fold lines to opposite side panels;

opposite end panels connected by fold lines to the side panels;

a strap connected to the side panels and extending therebetween;

a handle connected to the carrier for lifting the carrier;

the strap being connected along fold lines at opposite ends thereof to glue flaps, the glue flaps being adhered to the side panels;

one of the glue flaps being integrally connected to one of the side panels; and each side panel including an upper edge, said one glue flap being integrally connected to the upper edge of said one side panel by a fold line.

6. A basket-style carrier as defined in claim 5, wherein the strap is substantially centrally located.

7. A basket-style carrier as defined in claim 5, wherein the handle is connected to and extends between the end panels.

* * * * *